US007140080B2

(12) United States Patent
Fildan et al.

(10) Patent No.: US 7,140,080 B2
(45) Date of Patent: Nov. 28, 2006

(54) LINGERIE STRAP SLIDE ASSEMBLY

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 0 days.

(21) Appl. No.: 11/107,994

(22) Filed: Apr. 14, 2005

(65) Prior Publication Data

US 2006/0230585 A1 Oct. 19, 2006

(51) Int. Cl.
*A44B 15/00* (2006.01)

(52) U.S. Cl. ..... 24/302; 24/198; 24/200; 24/194; 450/86

(58) Field of Classification Search ..... 24/200, 24/185, 265 AL; 450/86
See application file for complete search history.

(56) References Cited

U.S. PATENT DOCUMENTS

| | | | | |
|---|---|---|---|---|
| 3,077,650 A * | 2/1963 | Horne | ..... | 24/200 |
| 5,177,837 A * | 1/1993 | Rekuc | ..... | 24/198 |
| 6,056,625 A * | 5/2000 | Fildan | ..... | 450/86 |
| 6,056,626 A * | 5/2000 | Fildan | ..... | 450/86 |
| 6,059,634 A * | 5/2000 | Fildan | ..... | 450/86 |
| 6,435,940 B1 * | 8/2002 | Fildan et al. | ..... | 450/86 |

* cited by examiner

*Primary Examiner*—Robert J. Sandy
*Assistant Examiner*—Marcus Menezes
(74) *Attorney, Agent, or Firm*—Andrew Wilford

(57) ABSTRACT

A lingerie strap and slide assembly has the central bar of the slide of set or recessed and formed with spikes to which the strap end is welded. The slide has its thickest portions at the centers of the transverse bars at which the central bar merges with the remainder of the slide. The strap passes around the central bar or directly through one of the slots to a ring and returns through that slot across the central bar and through the other slot in the slide to the shoulder of the wearer.

10 Claims, 4 Drawing Sheets

LINGERIE STRAP SLIDE ASSEMBLY

FIELD OF THE INVENTION

Our present invention relates to a strap assembly for lingerie and brassieres extending principles set forth in our application Ser. No. 10/436,818 filed 13 May 2003 (now U.S. Pat. No. 6,904,648) and, more particularly, to a strap and slide assembly for brassieres and other lingerie articles which can be thinner than earlier strap assemblies for this purpose.

BACKGROUND OF THE INVENTION

As has been noted in the above-identified application, which is hereby incorporated entirely by reference, a strap assembly for a brassiere or other lingerie article can comprise a slide having a pair of parallel slots through which the strap is guided in part around a central bar separating the slots. In a welded slide version of this assembly, the end of the strap may be welded to a flank of the central bar. In prior art to that application, the end of the strap was welded to one side of the central bar and extended from the slide directly to a ring connected to the garment and back through the ring through the slots of the slide and along the opposite side of the central bar to the shoulder of the wearer.

In an improvement over that arrangement covered by the application, the end of the strap was welded to the central bar at the same side as the return stretch of the strap passed around the central bar through the two slots. The improved arrangement provided greater security against undesired movement of the slide and advantages with respect to thickness of the assembly, etc.

While the latter arrangement has been found to be highly effective, nevertheless, improvement is desirable with respect to the appearance of the assembly, the reliability thereof, the thickness and the ability to adjust the slide.

Welded arrangements, moreover, have advantages over many prior art systems in which the strap is anchored to the slide by looping around a bar thereof and stitching the free end of the looped portion of the strap to another portion thereof.

OBJECTS OF THE INVENTION

It is thus an important object of the invention to advance the principles set forth in application Ser. No. 10/436,818 and to provide an improved slide and strap assembly which retains advantages of that system over the prior art but has a thinner aspect and improved aesthetics.

Another object of this invention is to provide an improved slide for a lingerie or brassiere strap which is free from prior art drawbacks and can be used effectively with improved threading of the strap therethrough to yield a thinner slide and strap assembly.

SUMMARY OF THE INVENTION

These objects and others which will become apparent hereinafter are attained, in accordance with the invention, in a lingerie strap slide comprising a one-piece generally rectangular body with rounded corners and having a pair of outer mutually parallel longitudinal bars merging at the corners with mutually parallel transverse bars, each of the transverse bars tapering from a central region of greatest thickness toward the corners and from the greatest thickness to a thickness of ¾ to ¼ of the greatest thickness. The body is formed with a central bar bridging the central regions, parallel to the outer bars and defining respective slots on opposite sides of the central bar through which a lingerie strap can pass, the longitudinal bars, the transverse bars and the central bar having flanks on one side lying in a common plane of the body. The central bar is offset at the central regions toward the plane and having a flank on an opposite side of the central bar from the plane provided with a row of formations tapered away from the plane and facilitating welding of an end of the strap to the central bar. The central bar and the longitudinal bars having thicknesses transverse to the plane from ¾ to ¼ of the greatest thickness.

The formations, which facilitate the welding of the end of the strap to the central bar can be pointed spikes which can pierce the thin end of the strap and, upon piercing the strap can be rounded over in the welding process. Where the strap is not pierced, the spikes can provide additional surface area upon being rounded over the strap to ensure that the strap will be securely welded to the central bar.

The system thus can use very thin straps which may not be composed of materials which themselves are amenable to ultrasonic and/or thermal welding to the slide.

The lingerie strap and slide assembly can comprise a slide in the form of a one-piece generally rectangular body with rounded corners and having a pair of outer mutually parallel longitudinal bars merging at the corners with mutually parallel transverse bars. Each of the transverse bars tapers from a central region of greatest thickness toward the corners and from the greatest thickness to a thickness of ¾ to ¼ of the greatest thickness. The body is formed with a central bar bridging the central regions, parallel to the outer bars and defining respective slots on opposite sides of the central bar with the longitudinal bars. The longitudinal bars, the transverse bars and the central bar have flanks on one side lying in a common plane of the body. The central bar is offset at the central regions toward the plane and having a flank on an opposite side of the central bar from the plane provided with a row of formations tapered away from the plane to the central bar. The central bar and the longitudinal bars have thicknesses transverse to the plane from ¾ to ¼ of the greatest thickness. A strap having an end welded to the flank provided with the row of formations, passes through one of the slots to a ring, back from the ring through the one of the slots against the end of the strap and then through the other of the slots.

It has been found to be advantageous to keep that greatest thickness of the transverse bars of the slide at about 1.8 mm and the thickness of the central bar at about 1.2 mm.

The end of the strap can be looped over the central bar in passing through the one of the slots or can pass through that one slot directly from the central bar.

The strap is looped through a ring which may be provided with flanges for communication to the fabric in a sandwiching construction or may be part of a double ring connected by a strap to the fabric. The ring through which the strap is threaded can be openable according to a feature of the invention.

The result is a shoulder strap assembly which is thinner and flatter than earlier constructions, provides a better grip of the slider with the strap to prevent the shoulder from slowly sliding down while the brassiere is worn, permits a variety of compositions and materials to be used for the strap and nevertheless secure it to the slide, permits the slide to be made with a shiny and robust appearance, notwithstanding the thin overall construction, and affords a saving in the length of strap which is, if formed, with a stitched loop, would have to be significantly longer.

The offset or recessed central bar construction allows the slide to have a parting plane, i.e. the plane at which the mold halves adjoin in forming the slide, which is located almost at the outside of the slide or only 0.3 to 0.4 mm away from the side of the slide turned toward the body of the wearer, thereby allowing sharp edges to be formed which can engage the strap and prevent self stripping of the slide on the strap.

BRIEF DESCRIPTION OF THE DRAWING

The above and other objects, features, and advantages will become more readily apparent from the following description, reference being made to the accompanying drawing in which.

SPECIFIC DESCRIPTION

Figure 3:
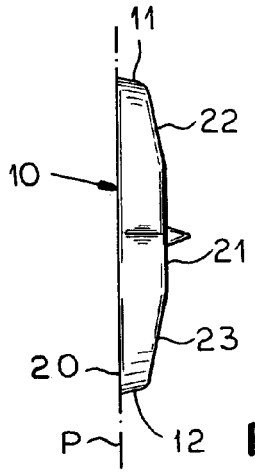
FIG. 3 is an end view of the slide.
Figure 1:
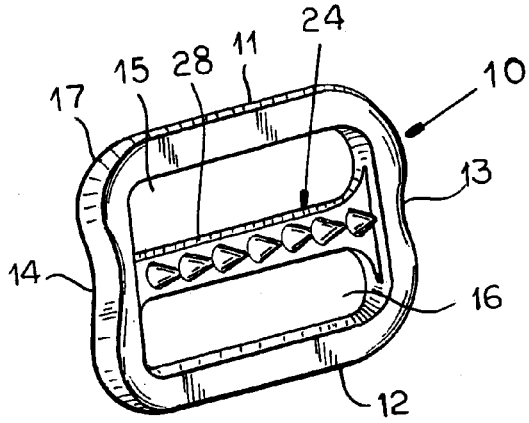
FIG. 1 is a perspective view of the slide from the side turned away from the body of the wearer.
Figure 2:
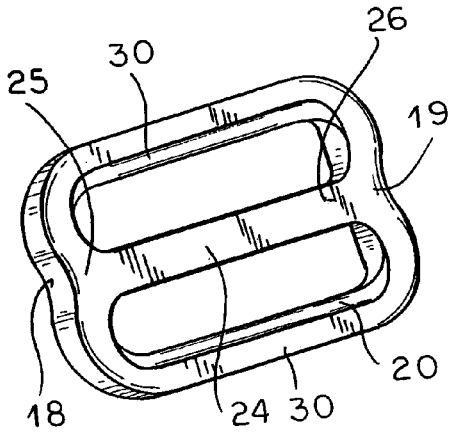
FIG. 2 is a perspective view of he slide of the slide turned toward the wearer.
Figure 4:
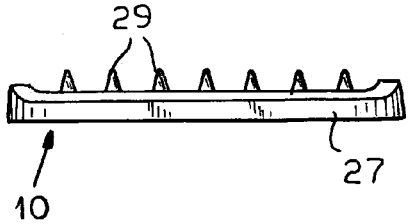
FIG. 4 is a side view of the slide.
Figure 5:
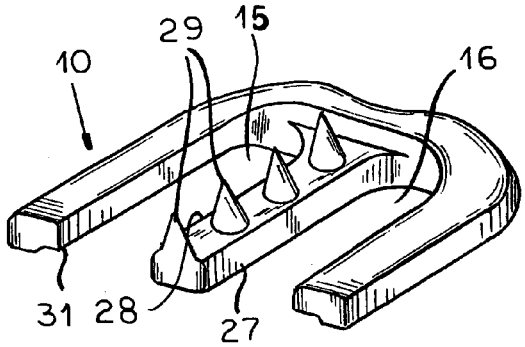
FIG. 5 is an enlarged perspective sectional view of the slide showing the spikes in detail.

In FIGS. 1 to 5, we show a slide 10 which comprises two parallel longitudinal bars 11, 12 connected by the transverse bars 13, 14 and defining openings 15 and 16 through which a strap can extend.

The slide is generally of rectangular configuration with rounded corners 17 and indented waists 18 and 19 in the transverse bars 13 and 14.

As can be seen from FIG. 3, the side of the slide turned toward the wearer and indicated at 20 can lie in a plane P. The transverse bars 13 and 14 have their thickest portions 21 at approximately the center and taper at 22 and 23 toward the longitudinal bars 11 and 12. At the thickest portion 21, the slide may have a thickness of 1.8 mm measured perpendicular to the plane P.

The slots 15 and 16 are separated by a central bar 24 merging at 25 and 26 with the transverse bars 13 and 14 and having its rear flank 27 in the plane P. The front flank 28, however, is recessed below the regions 21 of greatest thickness and to that end the thickness of the central bar 24 may be 1.2 mm. However, the central bar is also formed with a row of pointed spikes 29 which can pierce the strap during the welding operation. The slide 10 is formed in one piece. At its rear surface 20, the one slide may be indented at 30 to form sharp edges 31 along the slots 15 and 16 to promote gripping of the strap traversing these slots.

Figure 6:
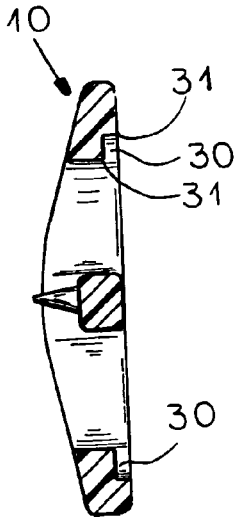
FIG. 6 is a transverse cross sectional view through the slide.
Figure 7:
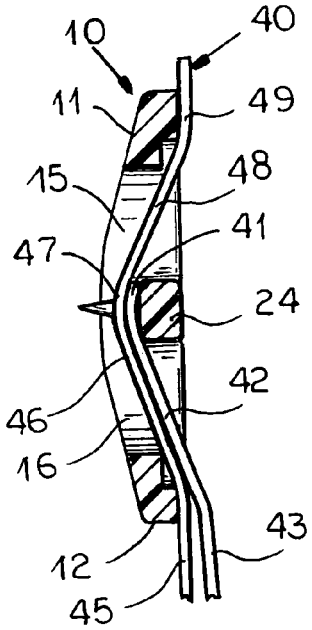
FIG. 7 is a cross sectional view showing one threading arrangement for the strap.
Figure 8:
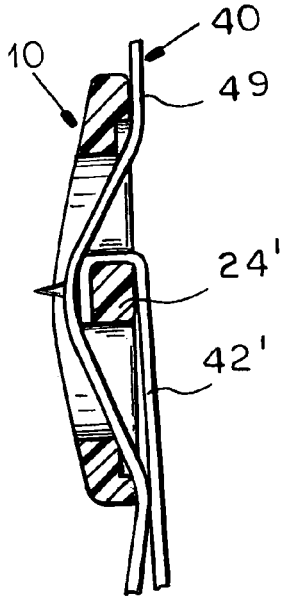
FIG. 8 is a similar view of a second threading arrangement.
Figure 9:
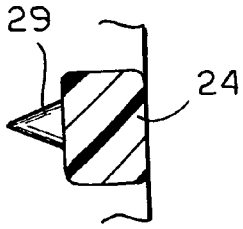
FIG. 9 is a detail section showing the central bar before welding.
Figure 10:
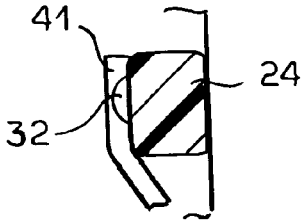
FIG. 10 is a detail showing the cental bar after welding in the arrangement of FIG. 7.

In FIGS. 7 and 8, the slide 10 (shown in FIG. 6 without the strap), can be seen to have a strap 40 threaded therethrough. In FIG. 7, the strap 40 has its end 41 welded to the central bar 24 (see also FIG. 10) thereby rounding at 32 the spikes 29 and securing the strap to the central bar. A stretch 42 of the strap then passes through the slot 16 across the rear of the longitudinal bar 12 down to a ring connected to the fabric of the brassiere ro lingerie article at 43 and back up from the loop 44 through that ring at 45, through the slot 16 at 46, around the bar 24 at 47, through the slot 15 at 48 and around the back of the bar 11 at 49. At 47, the strap 40 rides over the end 41 welded to the central bar 24. In this embodiment there can be a saving of say an inch in the length of strap over arrangements in which the strap end is looped over a central bar and sewn.

Figure 11:
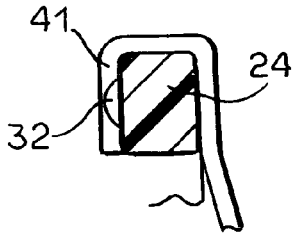
FIG. 11 is a view similar to FIG. 10 but showing the case of the embodiment of FIG. 8.
Figure 12:
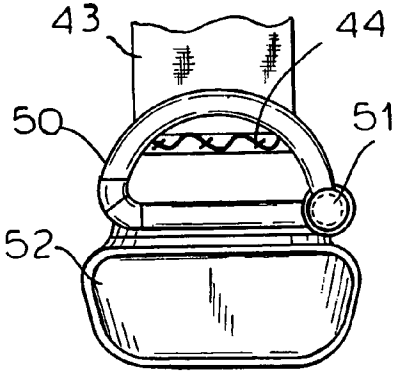
FIG. 12 is an elevational view, partly broken away showing a ring arrangement through which the strap can pass.
Figure 15:
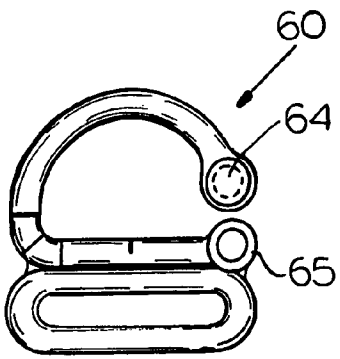
FIG. 15 is a perspective view of the ring in this position.

In the arrangement of FIGS. 8 and 11 the end 41 of the strap is welded to the central bar 24 at the spikes 32 but then passes over the central bar at 42'. The threading is otherwise the same. From the stretch 49, the strap passes over the shoulder of the wearer. From FIG. 12 shows that the strap can be looped at 44 through a half ring 50 which can be opened at 51 to allow lateral insertion of the loop. The half ring 50 is provided with a flange 52 which can be secured to the fabric by stitching or ultrasonic welding in a sandwich construction, portions of the fabric overlying and underlying the flange and being stitched together through the flange.

Figure 13:
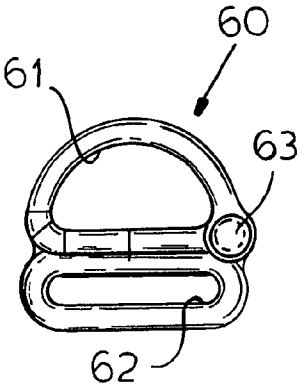
FIG. 13 is an elevational view of another embodiment of a ring which can be used with either the threading arrangement of FIG. 7 or that of FIG. 8.

The ring 60 of FIG. 13 through which the strap of FIGS. 7 and 8 can be looped, comprises two half rings 61 and 62, one of which can receive the strap 40 while the other is traversed by a loop connected to the fabric. The half ring 61 can be opened at 63 to facilitate lateral insertion of the strap or loop.

In the embodiments of FIGS. 7 and 8, the overall thickness of the assembly can be 1.8 mm plus twice the thickness of the strap. Because the thickness where the strap is joined to the middle bar of the slide is 1.2 mm and the smallest thickness of the longitudinal bars can be 1.2 mm, the overall thickness of the assembly is greatly reduced by comparison with earlier systems. In these embodiments, moreover, the returning stretch of strap covers the weld connection of the strap to the central bar.

Figure 14:
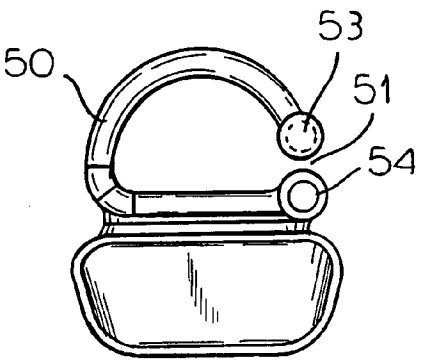
FIG. 14 is a view of the ring arrangement in FIG. 12 showing the ring in its open position.

In FIG. 14 we have shown the ring of FIG. 12 in its open position, the gap 51 being formed by lateral withdrawal of a pin 53 from an eye 54. The ring 50 is sufficiently flexible to allow deflection out of the plan of the closed ring for such opening. The pin 50 can laterally snap back into the eye 54 when the ring is to be closed. This construction allows the ring to be used like a lingerie hook for lateral insertion of the strap, but provides the advantages of a closed ring as well.

Figure 16:
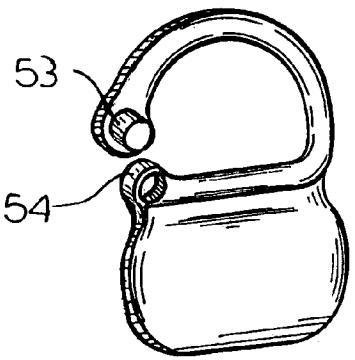
FIG. 16 is a view of the ring of FIG. 13 in its open position.

In the ring of FIG. 13, which is shown open in FIG. 16, a pin 64 is provided which can engage laterally in the eye 65 and can be pulled out of that eye into the hook position (FIG. 16) for lateral insertion of the strap loop.

Figure 18:
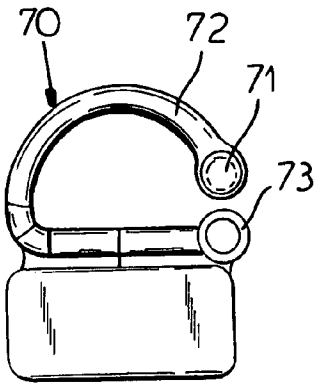
FIG. 18 is an elevational view of another embodiment of the openable ring seen in the open position.
Figure 19:
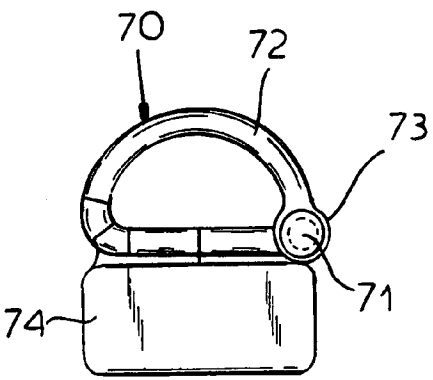
FIG. 19 is a view of this embodiment in the closed position.
Figure 17:
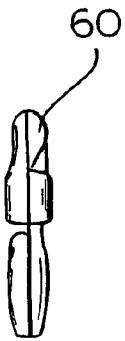
FIG. 17 is a side view of this ring.
Figure 20:
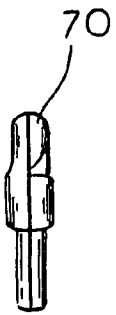
FIG. 20 is a side view of the latter ring.

In FIGS. 18 through 20, we have shown another embodiment of the combined hook and ring 70 which can have a pin 71 at the end of the arcuate arm 72 which can laterally engage in and be pulled from the eye 73 in the manner described. Either the flange of the embodiment of FIG. 12 can be provided at 74 or another arrangement for attaching the ring to the fabric can be used.

We claim:

1. A lingerie strap and slide assembly comprising:

a one-piece generally rectangular slide with rounded corners and having a pair of outer mutually parallel longitudinal bars, a pair of mutually parallel transverse bars merging at the corners with the longitudinal bars and each tapering from a central region of greatest thickness toward the corners, a central bar bridging the central regions of the transverse bars, extending parallel to the longitudinal outer bars and defining respective slots on opposite sides of the central bar, the longitudinal bars, the transverse bars and the central bar having rear flanks on a rear side lying in a common plane of the body, the central bar being between the central regions toward the plane and having a front flank on an opposite side of the central bar from the plane and provided with a row of formations tapered forward away from the plane to the central bar; and a strap having an end welded to the flank and extending rearward therefrom over the central bar and then in the plane against the rear flank of the central bar to an attachment location on a piece of lingerie.

2. The lingerie strap slide defined in claim 1 wherein said formations are pointed.

3. The lingerie strap slide defined in claim 2 wherein said greatest thickness is about 1.8 mm and the thickness of said central bar is about 1.2 mm.

4. The lingerie strap slide defined in claim 3 wherein said body is composed of a weldable synthetic resin.

5. The lingerie strap and slide assembly defined in claim 1 wherein said strap is looped through a ring.

6. The lingerie strap and slide assembly defined in claim 5 wherein said ring is configured to be openable to receive said strap.

7. The lingerie strap and slide assembly defined in claim 6 wherein said ring is provided with a flange for sandwiching between fabric layers.

8. The lingerie strap and slide assembly defined in claim 6 wherein said ring has two ring parts, said strap being threaded through one of said ring parts, another strap being threaded through the other of said ring parts.

9. The lingerie strap and slide assembly defined in claim 6 wherein said ring has an arcuate arm provided with a pin laterally engageable in an eye.

10. The assembly defined in claim 1 wherein the formations are rounded upon welding of the strap to the front flank provided with the formations.

* * * * *